US009278250B2

(12) United States Patent
Buchanan

(10) Patent No.: US 9,278,250 B2
(45) Date of Patent: Mar. 8, 2016

(54) CLAMP ASSEMBLY FOR AN ELLIPTICAL EXERCISE MACHINE

(71) Applicant: ICON Health & Fitness, Inc., Logan, UT (US)

(72) Inventor: Dale Buchanan, Nibley, UT (US)

(73) Assignee: ICON Health & Fitness, Inc., Logan, UT (US)

( * ) Notice: Subject to any disclaimer, the term of this patent is extended or adjusted under 35 U.S.C. 154(b) by 0 days.

(21) Appl. No.: 14/581,943

(22) Filed: Dec. 23, 2014

(65) Prior Publication Data

US 2015/0182789 A1 Jul. 2, 2015

Related U.S. Application Data

(60) Provisional application No. 61/921,399, filed on Dec. 27, 2013.

(51) Int. Cl.

| | |
|---|---|
| ***A63B 22/06*** | (2006.01) |
| ***A63B 21/00*** | (2006.01) |
| ***A63B 22/00*** | (2006.01) |
| ***A63B 21/055*** | (2006.01) |

(52) U.S. Cl.

CPC ..... *A63B 22/0664* (2013.01); *A63B 21/151* (2013.01); *A63B 22/001* (2013.01); *A63B 21/0557* (2013.01); *A63B 2022/067* (2013.01); *A63B 2022/0682* (2013.01)

(58) Field of Classification Search

CPC ..... A63B 22/001; A63B 22/0664–2022/0688; A63B 21/151; A63B 21/4033; A63B 21/4034

See application file for complete search history.

(56) References Cited

U.S. PATENT DOCUMENTS

| | | | | |
|---|---|---|---|---|
| 5,993,359 | A | 11/1999 | Eschenbach | |
| 6,422,977 | B1 | 7/2002 | Eschenbach | |
| 7,468,021 | B2 | 12/2008 | Moon | |
| 7,618,350 | B2 | 11/2009 | Dalebout et al. | |
| 7,674,205 | B2 | 3/2010 | Dalebout et al. | |
| 8,021,275 | B2 * | 9/2011 | Rodgers, Jr. ..... | A63B 21/151 482/52 |
| 2006/0217234 | A1 * | 9/2006 | Rodgers ..... | A63B 21/154 482/52 |
| 2007/0054779 | A1 | 3/2007 | Lee | |
| 2008/0076639 | A1 | 3/2008 | Fon | |
| 2010/0041522 | A1 | 2/2010 | Dalebout | |
| 2010/0267524 | A1 * | 10/2010 | Stewart ..... | A63B 22/001 482/52 |
| 2012/0108402 | A1 * | 5/2012 | Rodgers, Jr. ..... | A63B 21/155 482/110 |

OTHER PUBLICATIONS

International Search Report issued for PCT/US2014/072381 on Mar. 31, 2015.

* cited by examiner

*Primary Examiner* — Oren Ginsberg
*Assistant Examiner* — Jennifer M Deichl
(74) *Attorney, Agent, or Firm* — Holland & Hart LLP

(57) ABSTRACT

A clamp assembly for a track of an elliptical exercise machine has a base member, a clamp member, and a strap. The base member is coupled to a guide rail of the elliptical and has at least one base-fastener orifice. The clamp member is pivotally coupled to the base member and has at least one clamp-fastener orifice. The strap is proximate the base member and the clamp member and has at least one strap-fastener orifice. The at least one base-fastener orifice, the at least one clamp-fastener orifice, and the at least one strap-fastener orifice are positioned to collectively receive a securing fastener.

20 Claims, 13 Drawing Sheets

CLAMP ASSEMBLY FOR AN ELLIPTICAL EXERCISE MACHINE

RELATED APPLICATIONS

This application claims priority to provisional Patent Application No. 61/921,399 titled "Clamp System for Belt Coupling on Elliptical Exercise Machine" filed Dec. 27, 2013. This application herein is incorporated by reference for all that it discloses.

BACKGROUND

The following relates generally to exercise machines, and more particularly to the field of coupling belt tracks to elliptical exercise machines.

Exercise machines having alternating reciprocating foot supports configured to traverse or travel about a closed path to simulate a striding, running, walking, or climbing motion for the individual using the machine are well known and are commonly referred to as elliptical exercise machines or elliptical cross-trainers. In general, an elliptical or elliptical-type exercise machine comprises a pair of reciprocating foot supports designed to receive and support the feet of a user. Each reciprocating foot support has at least one end supported for rotational motion about a pivot point (e.g., a pivot end) with the other end supported in a manner configured to cause the reciprocating foot support to travel or traverse a closed path, such as a reciprocating elliptical or oblong path or other similar geometric outline (e.g., a closed path end). Therefore, upon operation of the exercise machine, each reciprocating foot support is caused to travel or traverse the closed path, thereby simulating a striding motion for exercise purposes. Typically, the reciprocating foot supports are configured to be out of phase with one another by approximately 180 degrees to simulate a natural stride motion.

An individual may utilize an elliptical exercise machine by placing his or her feet onto the reciprocating foot supports. Once standing on the foot supports, the individual may actuate the exercise machine for any desired length of time at any desired pace causing the reciprocating foot supports to repeatedly travel their respective closed paths. This action effectively results in a series of strides achieved by the individual to obtain a desired level of exercise, such as distance traveled or calories burned. Exercise achieved using an elliptical exercise machine is particularly favored by individuals seeking aerobic exercise with little or no physical impact to their frame and joints.

One type of elliptical exercise machine includes a roller carried at the closed path end of the reciprocating foot support. The roller is supported by a track member. Other types of elliptical exercise machines have the roller positioned under the track member, and the track member is moved along with the foot support of the machine through the closed path. Opposing ends of the track member define a maximum travel distance for the reciprocating foot support. The roller usually does not contact either of the opposing ends of the track member when the user is operating the elliptical exercise machine in a normal stride. However, the roller contacts at least one of the ends of the track member when longer than normal strides are taken. This contact can result in high impact forces creating additional wear and stress in the machine and potential discomfort for the user.

An example elliptical exercise machine including a track member is disclosed in U.S. Pat. No. 7,618,350 issued to William T. Dalebout et al. and assigned to Icon IP, Inc. In this patent, an elliptical exercise machine includes a pair of track members within which rollers connected to the reciprocating foot supports move during operation of the machine. The track members define straight tracks that support the rollers. Similar elliptical exercise machines can also be found in U.S. Pat. Nos. 5,993,359; 6,422,977; and 7,468,021 and U.S. Patent Publication Nos. 2010/0041522 and 2007/0054779. All of these references are herein incorporated by reference for all that they disclose.

In some elliptical exercise machines, flexible belts are used as part of a track apparatus. The belt is suspended at two ends between portions of a belt support member, and roller contacts the flexible belt between those ends, causing the belt to support (or be supported by) the roller. When the reciprocating foot support moves on the exercise machine, the roller slides or rolls relative to the length of the belt supported by the belt support member. As the roller moves, the radius of curvature of the belt with respect to the belt support member increases in the direction of the motion of the roller due to slack in the belt. At the center of the belt, the radius of curvature is at its lowest, and as the roller approaches one of the suspended ends, the radius gradually increases. This gradual change in resistance against the roller provides a smoother striding effect for the user by reducing the chance that the roller will contact the end of a track member when the user takes a long stride.

In these machines, the length of the belt must be carefully managed. With too much slack, the user may experience unsatisfactory high impact forces as the roller causes the belt to contact the rigid belt support member. With too little slack, the range of change of the radius of curvature permitted by the belt may be too limited to give the desired range of resistance for a natural feel to the exercise machine and a perceptible ramp-up toward the ends of the belt. Ideally, then, the belt is suspended in the track apparatus tightly enough to prevent the roller from contacting the remaining track apparatus, but loosely enough to give a satisfactory range of radius change as the roller moves relative to the belt surface.

Retaining a belt at this carefully measured length can be difficult. Belts in elliptical exercise machines are subject to wear and stretching and may need to be adjusted or replaced over time. Thus, permanent attachment is not preferable, but non-permanent attachment systems must ensure safety and security while holding the belt and also be low-cost and easily serviceable. Existing belt-rolling elliptical exercise machines do not provide a sufficient combination of these features.

SUMMARY

In one aspect of the invention, a clamp assembly for a track of an elliptical exercise machine is disclosed.

In one aspect of the invention, the clamp assembly may comprise a base member coupled to a guide rail of the elliptical, the base member may have at least one base-fastener orifice.

In one aspect of the invention, the clamp assembly may comprise a clamp member pivotally coupled to the base member, the clamp member may have at least one clamp-fastener orifice.

In one aspect of the invention, the clamp assembly may comprise a strap proximate the base member and the clamp member, the strap may have at least one strap-fastener orifice.

In one aspect of the invention, the at least one base-fastener orifice, the at least one clamp-fastener orifice, and the at least one strap-fastener orifice may be positioned to collectively receive a securing fastener.

In one aspect of the invention, the strap may be coupled to the base member with the securing fastener.

In one aspect of the invention, the clamp-fastener orifice may comprise a recess positioned to accept at least a portion of the securing fastener.

In one aspect of the invention, the strap may be clasped between the base member and clamp member.

In one aspect of the invention, a portion of the clamp member contacting the strap may be textured.

In one aspect of the invention, the clamp assembly may comprise a plurality of rail connection extensions extending from a body of the clamp member, the plurality of rail connection extensions may pivotally connecting the clamp member to the base member.

In one aspect of the invention, the strap may be folded over itself at a first end of the strap.

In one aspect of the invention, the clamp member may comprise a recess for retaining at least a portion of the folded over strap.

In one aspect of the invention, the strap may extend from a first end of the base member to a second end of the base member opposite the first end.

In one aspect of the invention, a guide rail assembly for an elliptical exercise machine may be disclosed.

In one aspect of the invention, the guide rail assembly may comprise a guide rail pivotally coupled to a support structure for the elliptical exercise machine.

In one aspect of the invention, the guide rail assembly may comprise a base member comprising a first base end and a second base end opposite the first base end, a first base end may be pivotally coupled to the guide rail and at least one base-fastener orifice may be proximate one end of the base member.

In one aspect of the invention, the guide rail assembly may comprise at least one clamp member pivotally coupled to the base member, the clamp member may have at least one clamp-fastener orifice.

In one aspect of the invention, the guide rail assembly may comprise a strap proximate the base member and the clamp member, the strap may have at least one strap-fastener orifice.

In one aspect of the invention, the at least one base-fastener orifice, the at least one clamp-fastener orifice, and the at least one strap-fastener orifice may be positioned to collectively receive a securing fastener.

In one aspect of the invention, the strap may extend away from a longitudinal portion of the base member and the strap is coupled to the base member with the securing fastener.

In one aspect of the invention, a first strap end of the strap may be folded over itself and the first strap end may be secured by the at least one clamp member.

In one aspect of the invention, a body of the clamp member may comprise a recess, the recess may receive the fold of the strap.

In one aspect of the invention, the recess may be centrally-located on the body of the clamp member.

In one aspect of the invention, a spacer may be positioned within the fold of the strap between the recess of the body of the clamp member.

In one aspect of the invention, an elliptical exercise machine may comprise a support structure proximate a support surface.

In one aspect of the invention, an elliptical exercise machine may comprise a first foot support and a second foot support, each of the first and second foot supports movably linked to the support structure.

In one aspect of the invention, an elliptical exercise machine may comprise a first guide rail assembly and a second guide rail assembly positioned to guide reciprocal movement of the first and second foot supports.

In one aspect of the invention, an elliptical exercise machine may comprise at least one of the first and second guide rail assemblies which may include a base member coupled to a guide rail, the base member may have at least one base-fastener orifice.

In one aspect of the invention, an elliptical exercise machine may comprise a guide rail assembly including a clamp member pivotally coupled to the base member, the clamp member may have at least one clamp-fastener orifice.

In one aspect of the invention, an elliptical exercise machine may comprise a guide rail assembly including a strap proximate the base member and the clamp member, the strap may have at least one strap-fastener orifice.

In one aspect of the invention, an elliptical exercise machine may comprise a guide rail assembly wherein the at least one base-fastener orifice, the at least one clamp-fastener orifice, and the at least one strap-fastener orifice may be positioned to collectively receive a securing fastener.

In one aspect of the invention, the first and second guide rail assemblies may be fixed relative to the base support structure.

In one aspect of the invention, an elliptical exercise machine may comprise a drive assembly proximate a front portion of the elliptical exercise machine, each of the first and second foot supports may be link to the drive assembly such that each foot support may be movably linked to the base support structure.

In one aspect of the invention, an elliptical exercise machine may comprise a drive assembly proximate a rear portion of the elliptical exercise machine, each foot may be movable by the drive assembly such that each foot support may reciprocate around an axis formed by the drive assembly.

In one aspect of the invention, an elliptical exercise machine may comprise a guide rail assembly including an upright support structure extending upward from a front portion of the support structure.

Any of the aspects of the invention detailed above may be combined with any other aspect of the invention detailed herein.

BRIEF DESCRIPTION OF THE DRAWINGS

The accompanying drawings illustrate various embodiments of the present apparatus and are a part of the specification. The illustrated embodiments are merely examples of the present apparatus and do not limit the scope thereof.

Throughout the drawings, identical reference numbers designate similar, but not necessarily identical, elements.

DETAILED DESCRIPTION

An elliptical exercise machine including roller track assemblies having clamped strap ends is disclosed herein. Specifically, the present system provides an elliptical exercise machine having a roller track associated with each reciprocating foot support. The roller tracks are configured to increase resistance to movement as the rollers approach the ends of the roller tracks. This increased resistance helps avoid the rollers hitting a hard stop at opposing ends of the roller tracks. Such hard stops may create jarring forces or shock forces that are uncomfortable for the operator and may cause damage to the elliptical exercise machine. Furthermore, one or more strap clamps may ensure proper length of a strap in the track apparatus, preventing slippage of the strap while allowing repositioning or replacement of the strap as necessary.

The roller tracks include a strap surface that interfaces with the rollers. The strap surface may be flexible to accommodate changes in the radius of curvature experienced by an engaging roller as it applies pressure to the strap and moves along the strap surface. In one example, the entire roller track has one long strap extending from end to end and secured at the ends by clamps. Slack in the strap may provide greater deflection of the roller at the center of the strap track in comparison to the ends near the clamps. Thus, the radius of curvature experienced by the roller is typically less at the end portions of the strap than at the mid-section. This reduced radius of curvature at the end portions of the strap may increase the amount of force required to move the roller along the strap surface at the opposing end portions. This increased resistance to movement of the roller along the strap surface may help slow down the foot support at opposing ends of its reciprocating elliptical motion. In at least some configurations, the change in radius of curvature along the strap surface at the opposing end portions makes it unlikely that the roller will hit a hard stop at any point during its movement along the strap surface of the roller track.

For purposes of this disclosure, the term "aligned" means parallel, substantially parallel, or forming an angle of less than 35 degrees. For purposes of this disclosure, the term "transverse" means perpendicular, substantially perpendicular, or forming an angle between 55 and 125 degrees.

Figure 1:
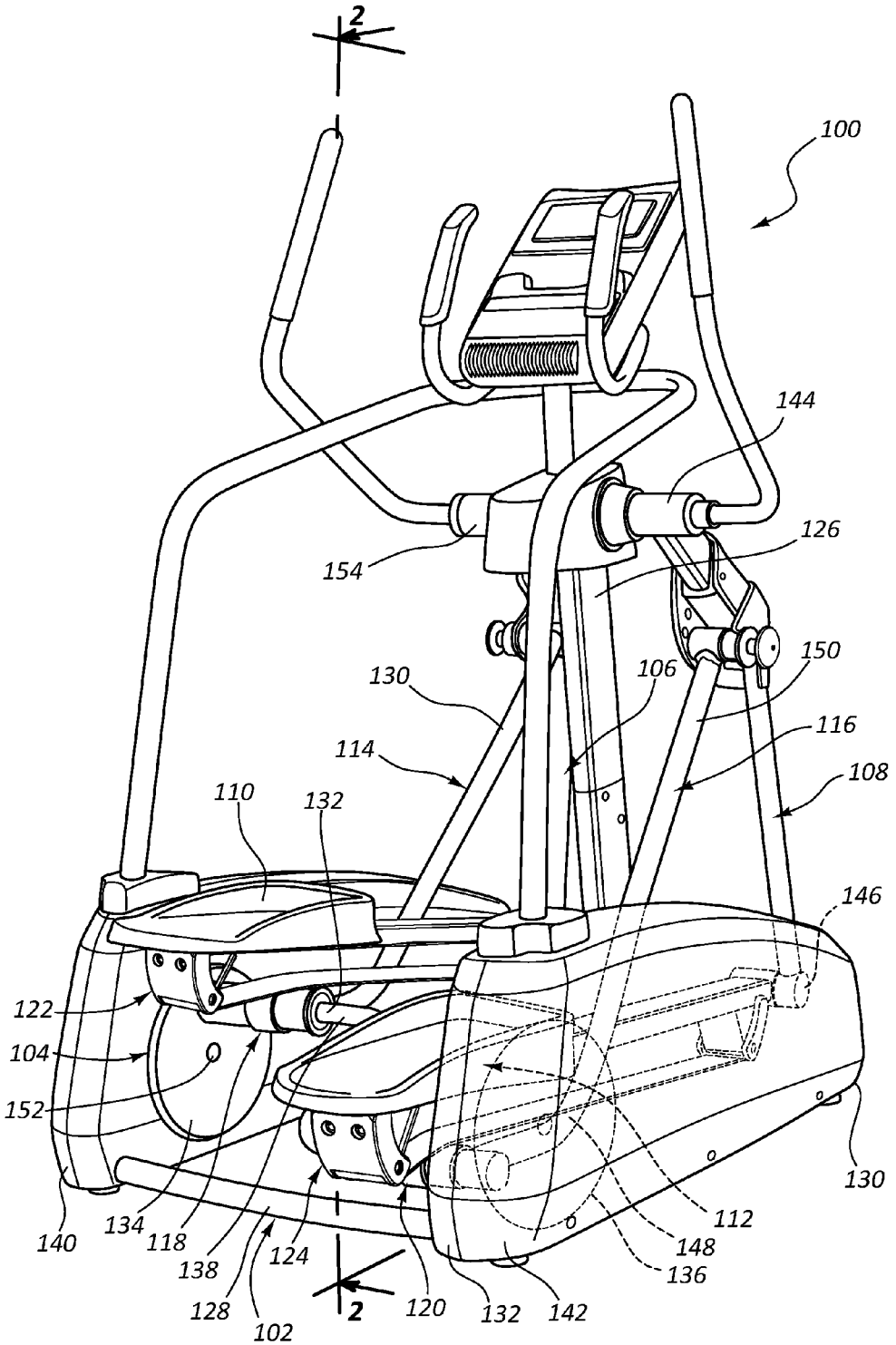
FIG. 1 is a perspective view of an example of an elliptical exercise machine having clamp assemblies in accordance with the present disclosure.

Particularly, with reference to the figures, FIG. 1 shows a rear perspective view of an elliptical exercise machine 100 according to the present systems and methods. The elliptical exercise machine 100 may include a frame 102, a drive assembly 104, first guide rail 106, a second guide rail 108, a first foot support 110, and a second foot support 112, a first linked arm 114, and a second linked arm 116, a first roller 118, a second roller 120, and a first clamp assembly 122, and a second clamp assembly 124. The frame 102 includes an upright support structure 126, and a base support structure 128. The base support structure 128 may be positioned on top of a support surface such as a gym floor.

The drive assembly 104 may include first and second drive members 134, 136 and a crank arm 138 extending between the first and second drive members 134, 136. The first and second drive members may be positioned in opposing housings 140, 142. Alternatively, a single drive member positioned in only one of the housings 140, 142 may be used to rotate crank arm 138. In some embodiments, as shown on FIG. 1, the drive assembly 104 may be proximate a rear portion of the elliptical exercise machine 100.

The crank arm 138 may comprise the first and second rollers 118, 120. The first and second rollers 118, 120 may be mounted to, affixed, or otherwise coupled to the crank arm 138. The first and second link arms 114, 116 may also connect to the crank arm 138. The crank arm 138 may be operated by at least one drive member 134, 136 which may cause a first end 132, 148 of the first and second link arms 114, 116 to rotate about an axis 152 formed by the drive assembly 104.

The first and second guide rails 106, 108 may each include a first pivot point 154, 144 and a second pivot point 156 (FIG. 2), 146. The first pivot points 154, 144 may substantially align and may be pivotally coupled to the upright support structure 126. The second pivot point 156, 146 may respectively provide a pivotal connection between the first and second guide rails 106, 108 and the first and second clamp assemblies 122, 124.

The first arm 114 may include first end 132 and a second end 130 (FIG. 2), opposite the first end 132. The second link arm 116 may include a first end 148 and a second end 150, opposite the first end 148. The first ends 148, 132 may connect to the crank arm 138. The second ends 150, 130 may pivotally connect to the first and second guide rails 106, 108. The rollers 118, 120 may traverse the undersides of the clamp assemblies 122, 124, as shown with reference to FIG. 2.

Figure 2:
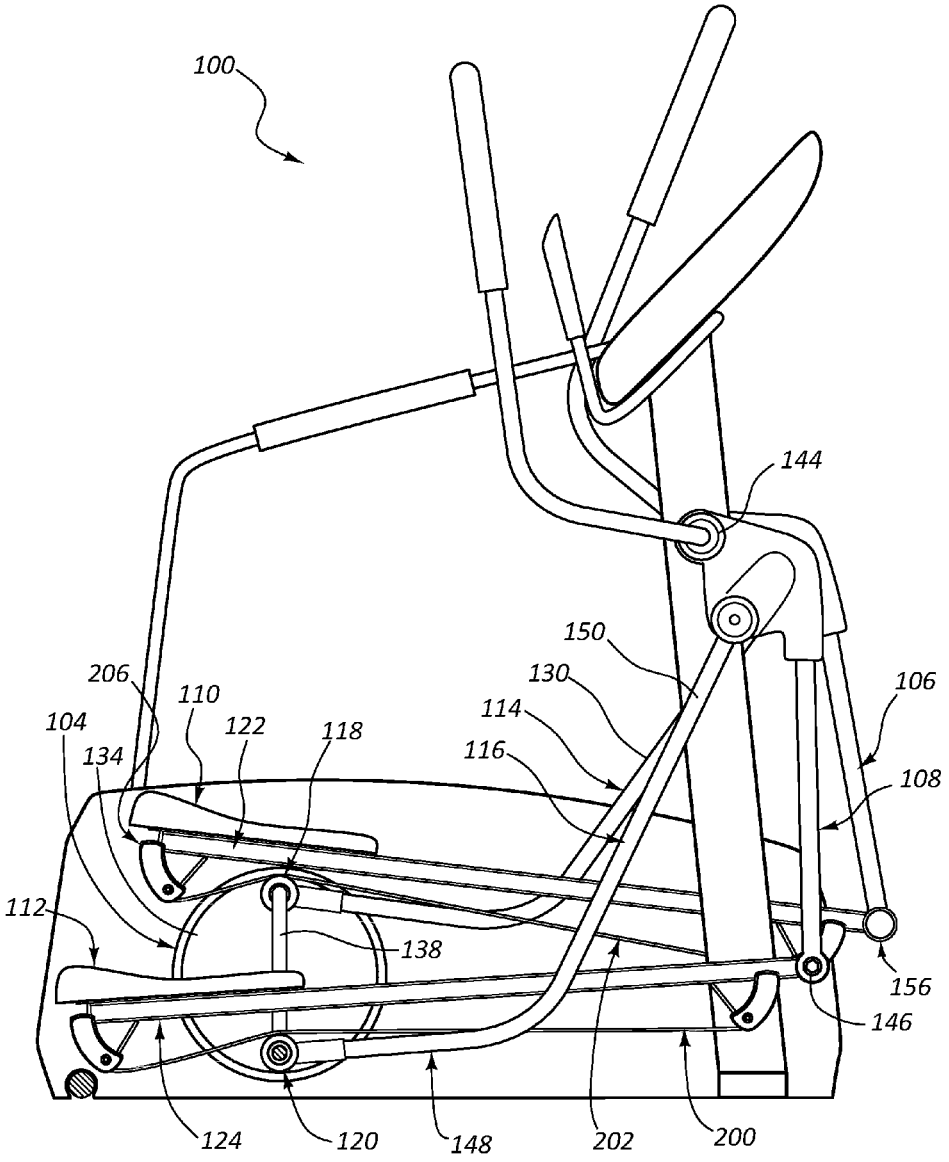
FIG. 2 is a side section view of an example of an elliptical exercise machine having clamp assemblies in accordance with the present disclosure.

FIG. 2 is a cross-sectional side view of an elliptical exercise machine 100 including rail assemblies having straps 200, 202 and clamp members 206 installed (one clamp is not visible in the figure). The section is taken vertically along the section indicator 2-2 shown in FIG. 1 with the housing 142 removed. The clamp assemblies 122, 124 may rest on the rollers 118, 120, thereby flexing the straps 200, 202. When the elliptical exercise machine 100 is in use, the rollers 118, 120 may traverse the straps 200, 202. As the rollers 118, 120 traverse the straps 200, 202, the radius of curvature of the straps 200, 202 may change based on the location of the roller 118, 120.

As shown in FIG. 2, the roller 118 is proximate an end of a first clamp assembly 122 causing the strap 202 to have a higher radius of curvature than the strap 200 of the second clamp assembly 124, which has the roller 120 relatively more centrally-located on the strap 200. Thus, as the reciprocating foot supports 110, 112 rotate about the axis 152 (FIG. 1) centered on the drive member 134, the radius of curvature of the straps 200, 202 on the clamp assemblies 122, 124 may change depending on the relative position of the clamp assemblies 122, 124 and the rollers 118, 120. This gradual increase in radius of curvature may tend to cause the user to need to gradually exert more and more force on the foot support 110, 112 to further advance the roller 118, 120 along the straps 200, 202 toward the end of the clamp assembly 122, 124. This increased resistance to movement may help to provide a smoother, lower-impact experience for the user. It may be difficult for the roller 118, 120 to collide with the or clamp assembly 122, 124, or if they do collide, the collision may occur at a lower velocity due to deceleration caused by the characteristics of the strap 200, 202. The foot supports 110, 112 may be movable by the drive assembly 104 such that each foot support 110, 112 reciprocates around an axis formed by the drive assembly 104.

Figure 3:
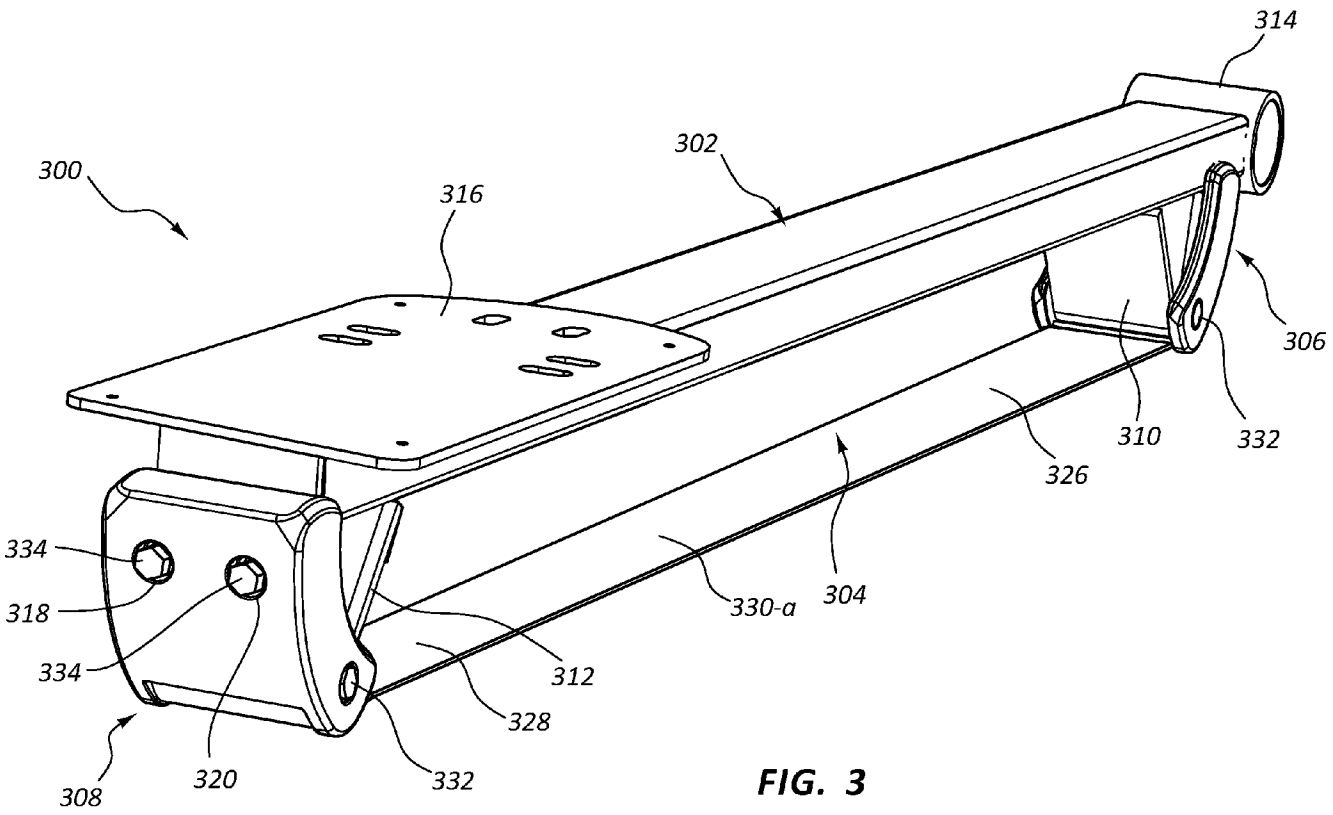
FIG. 3 is a perspective view of an example of a clamp assembly in accordance with the present disclosure.
Figure 4:
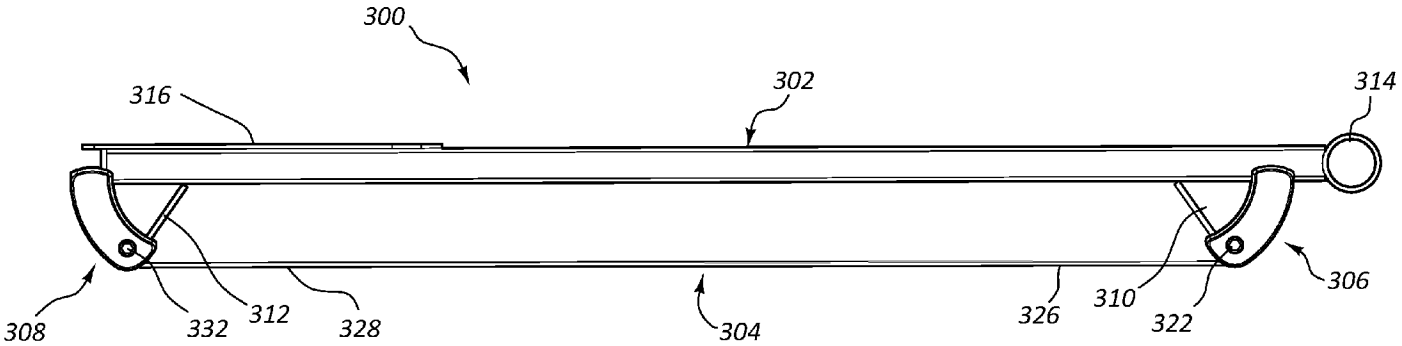
FIG. 4 is a side view of an example of clamp assembly in accordance with the present disclosure.
Figure 6:
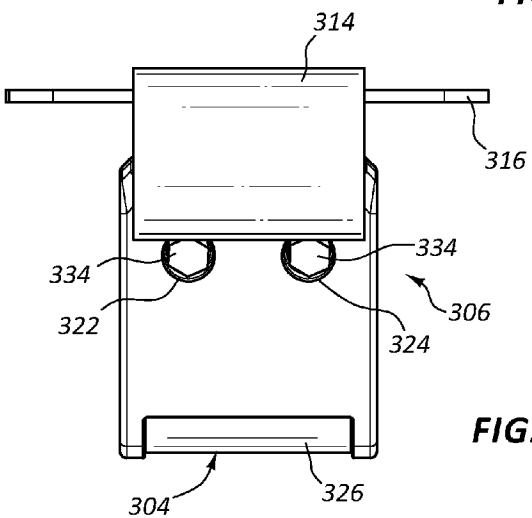
FIG. 6 is a front end view of an example of clamp assembly in accordance with the present disclosure.
Figure 5:
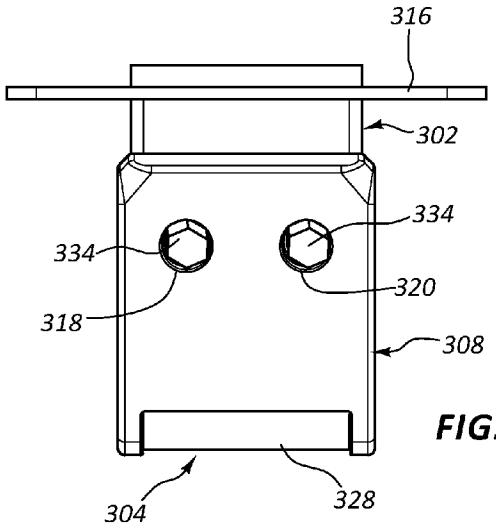
FIG. 5 is a rear end view of an example of a clamp assembly in accordance with the present disclosure.
Figure 7:
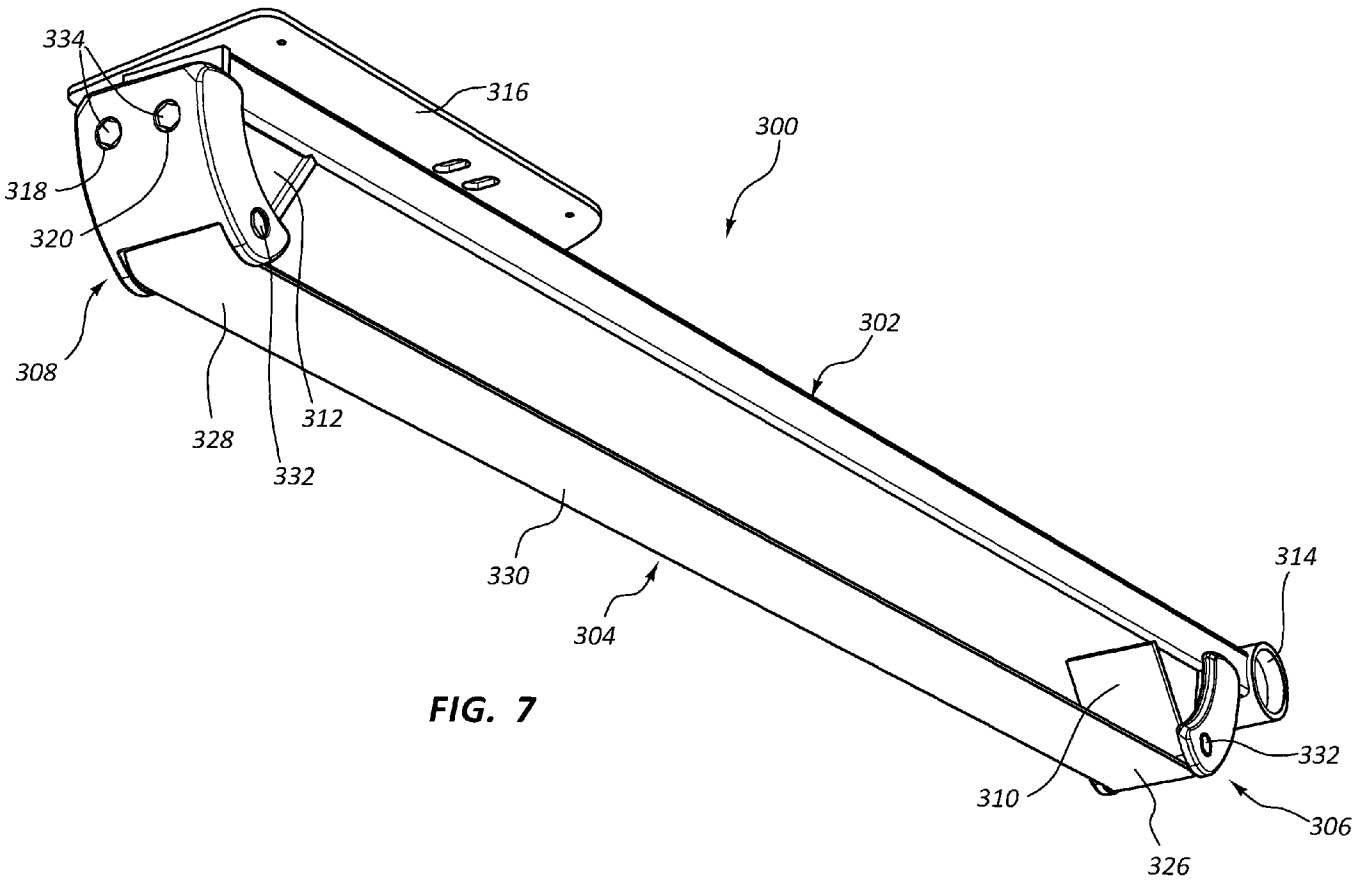
FIG. 7 is a lower perspective view of an example of a clamp assembly in accordance with the present disclosure.
Figure 8:
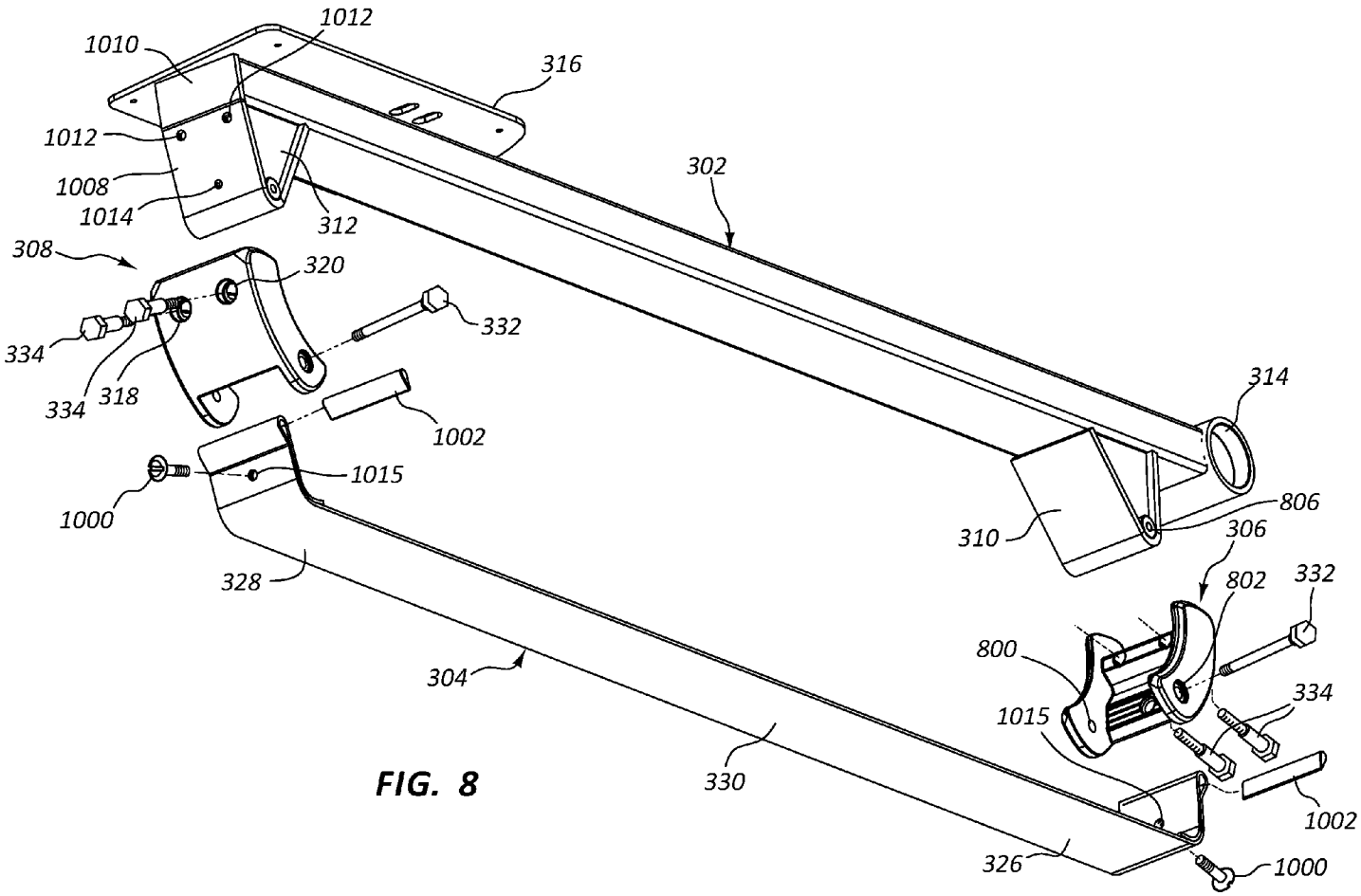
FIG. 8 is an exploded perspective view of an example of a clamp assembly in accordance with the present disclosure.
Figure 9:
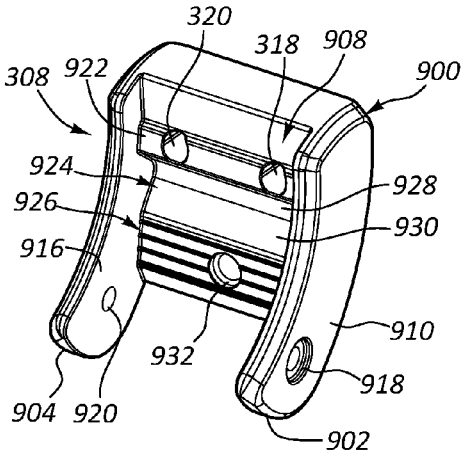
FIG. 9 is a perspective view of an example of a rear clamp member in accordance with the present disclosure.
Figure 10:
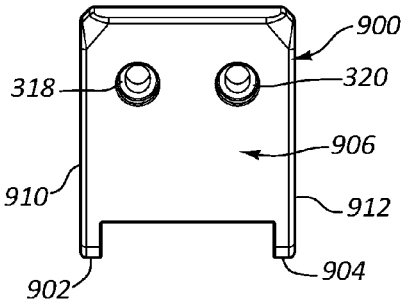
FIG. 10 is a rear view of an example of a rear clamp member in accordance with the present disclosure.
Figure 11:
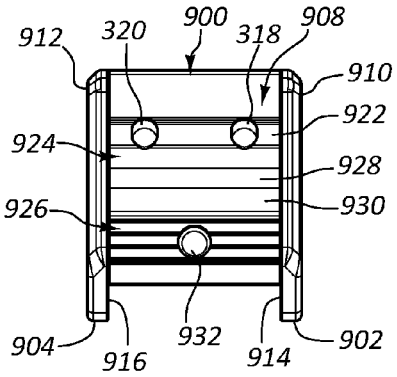
FIG. 11 is a front view of an example of a rear clamp member in accordance with the present disclosure.
Figure 12:
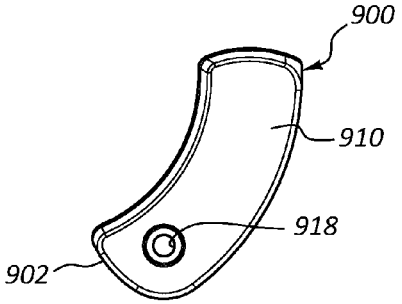
FIG. 12 is a left side view of an example of a rear clamp member in accordance with the present disclosure.
Figure 13:
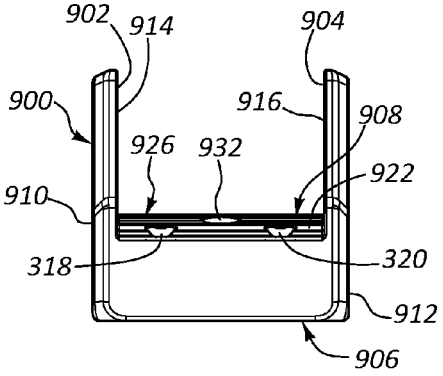
FIG. 13 is a top view of an example of a rear clamp member in accordance with the present disclosure.
Figure 14:
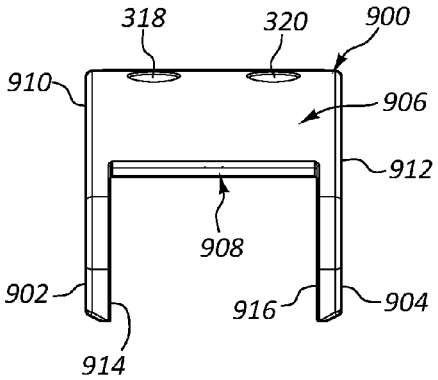
FIG. 14 is a bottom view of an example of a rear clamp member in accordance with the present disclosure.
Figure 15:
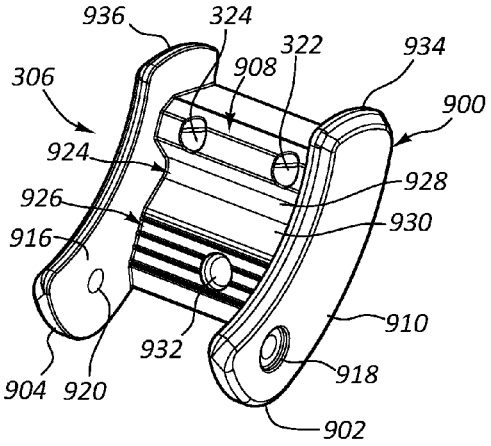
FIG. 15 is a perspective view of an example of a front clamp member in accordance with the present disclosure.

An example clamp assembly 300 is shown in isolation from an elliptical exercise machine in FIGS. 3-8. The clamp assembly 300 may be one example of the clamp assemblies 122, 124 described with reference to FIGS. 1 and/or 2. FIG. 3 depicts a perspective view of the clamp assembly 300; FIG. 4 depicts a side view of the clamp assembly 300; FIGS. 5 and 6 depict rear and front end views of the clamp assembly 300, respectively; FIG. 7 depicts a perspective view of the clamp assembly 300; and FIG. 8 depicts an exploded view of the clamp assembly 300. Common indicators may be used in each figure to refer to identical or equivalent parts.

As shown in FIG. 3, the clamp assembly 300 may include a base member 302, a strap 304, a front clamp member 306, and a rear clamp member 308. The strap 304 may be one example of the straps 200, 202 discussed with reference to FIG. 2. The front clamp member 306 and rear clamp member 308 may be one example of the clamp member 206 discussed with reference to FIG. 2. The base member 302 may include a first end and second end opposite the first end. The base member 302 may additionally include a front and a rear clamp extension member 310, 312, a pivot joint member 314 for providing a pivotal connection to an elliptical exercise machine (e.g. elliptical exercise machine 100), and a foothold attachment plate 316. The base member 302 may be pivotally coupled to a guide rail (e.g. guide rail 108 or 106) at a first end of the base member 302. The pivot joint member 314 may, for example, be linked to the elliptical exercise machine 100 of FIG. 1 at the second pivot point 146 or 156.

The base member 302 may comprise one or more of a metal, composite material, and polymer, including, without limitation, steel, aluminum, carbon fiber, and other suitable rigid material. The base member 302 may be substantially longitudinally straight and elongated with clamp extension members 310, 312 extending from each end of the base member 302. The first clamp extension member 310 may receive a front clamp member 306 and a first end 326 of the strap 304.

In other embodiments, the base member 302 may incorporate a straight shape or curved shape (not shown) such that the ends of the base member 302 itself may serve as points of attachment for the clamp members 306, 308 and strap 304 obscuring the need for the clamp extension members 310, 312. A curved base member 302 may suspend the strap 304 preventing contact with the base member 302 when a roller (e.g. roller 118, 120) contacts the strap 304. A non-linear base member 302 may involve an alternative attachment system for the foothold attachment plate 316 to provide adequate direction of the foot of the user on the elliptical exercise machine.

The strap 304 may comprise one or more flexible yet strong, durable, and substantially inelastic materials. For example, the strap 304 may have a fabric webbing incorporating nylon and polyester. In other embodiments, the strap 304 may be flexible due to linkages of rigid materials combined together to form a strap-like structure. For example, the strap 304 may comprise interlinked metal or PVC elements, or a rubberized or otherwise lined flexible metal mesh. In some cases, the strap 304 may incorporate plastics or another liner material to a roller surface 330 to provide a smoother glide for a roller.

The strap 304 may extend from a first end of the base member 302 proximate the pivot joint member 314 to a second end of the base member 302 opposite the first end. The strap 304 may include a first end 326 and a second end 328 secured by respective front and rear clamp members 306, 308. The strap 304 may be suspended away from a longitudinal portion of the base member 302 such that the strap 304 may flex towards the base member 302 without contacting it. The clamp members 306, 308 may provide convenient access to the strap 304 for its removal, adjustment, or replacement as required. The strap 304 may be flexed due to slack in its length. For example, when a roller (e.g., rollers 118, 120) contacts the strap 304, the roller may displace the strap 304 toward the base member 302 at a point of contact (see FIG. 2). The strap 304 may be sufficiently inelastic to prevent the roller from causing the strap 304 to contact the base member 302 under normal roller pressure. When the roller moves along the roller surface 330 toward one of the clamp extension members 310, 312, the point of contact of the roller may displace the strap 304 and decrease a distance between the roller and the base member 302. Additionally, the radius of curvature of the strap 304 experienced by the roller may increase in the direction of motion.

The clamp members 306, 308 may be pivotally coupled to the base member 302. For example, the clamp members 306, 308 may attach to the clamp extension members 310, 312. Pivot fasteners or pins 332 (see, e.g., FIG. 8) may be positioned through the clamp members 306, 308 and clamp extension members 310, 312 to provide an axis of rotation of the clamp members 306, 308 when the clamp members 306, 308 are opened or closed. As shown in FIG. 8, the pivoting of the clamp member 306 may be provided by aligning the pin 332 with a pair of thru-holes 800, 802 in the clamp member 306 and a thru-hole 806 in the clamp extension member 310. The rear clamp member 308 and clamp extension member 312 may have similar features. FIGS. 21-26 describe features of open and closed clamps in further detail. The clamp members 306, 308 may be constructed of various rigid, durable materials, including, for example, metals and plastics. For example, clamp members 306, 308 may comprise steel, brass, aluminum, acrylonitrile butadiene styrene (ABS), Polybutylene terephthalate (PBT), polyvinyl chloride (PVC), or combinations of these and other similar materials.

The clamp members 306, 308 may further comprise multiple orifices 318, 320, 322, 324 (see also FIGS. 9-20). The orifices 318, 320, 322, 324 may include a counter bore portion to receive a head of a clamp fastener 334. The clamp fasteners 334 may be positioned to secure the clamp members 306, 308 to the base member 302 in conjunction with the pin 332 at an axis of rotation of the clamp members 306, 308. As shown in further detail in FIGS. 21-26, the orifices 318, 320, 322, 324 may be positioned on the clamp members 306, 308 to attach the clamp members 306, 308 to the base member 302 without causing the clamp fastener 334 to contact or extend through the strap ends 326, 328 held by the clamp members 306, 308.

In some embodiments, the roller may move along a roller surface 330 (see FIGS. 7-8). For example, the roller may slide or roll along the roller surface 330. The roller surface 330 may have a width substantially equal to the width of the roller of the elliptical exercise machine. In some cases, the roller surface 330 may be narrower than the width of the roller to permit the strap 304 to move laterally across the top of the roller to some extent without twisting the strap 304 or producing higher stress on the roller surface 330 by contacting side areas or edges of the roller. As the roller approaches the ends 326, 328 of the strap 304, the roller surface 330 in the direction of motion may provide an increasing slope or decreasing radius of curvature to the roller. Thus, the strap 304 may create an increased resistance to movement of the roller as it moves towards the ends 326, 328, and a decreased resistance to movement as it moves towards the central portion of the strap 304. Increased resistance may slow down relative movement between the clamp assembly 300 and additional force may be necessary to continue the relative movement. In this manner, the roller may be less susceptible to abruptly coming into contact with the clamp extension members 310, 312 of the base member 302, providing a smoother ride for the operator. In some arrangements, the amount of force required for further relative movement once the roller reaches a certain position on the strap 304 relative to the clamp extension members 310, 312 increases substantially such that the roller either stops short of the clamp extension members 310, 312 or there is little to no impact force when the roller reaches the clamp extension members 310, 312 due to a decrease in relative momentum.

In alternative configurations not shown, the roller surface 330 may be a surface of the strap 304 facing the base member 302, such as surface **330-*a* of FIG. 3. In such embodiments, the roller may traverse the roller surface 330-*a* between the strap 304 and the base member 302. The clamp assembly 300 may be oriented as shown in FIGS. 3-7 with the strap 304 underneath the base member 302, but in alternative embodiments, the clamp assembly 300 may be oriented such that the strap 304 is above the base member 302 (see, e.g., FIG. 28 and description below). In such an embodiment, the foothold attachment plate 316 may be associated with a moving roller or structure holding the roller instead of the base member 302. Even in an inverted arrangement, the roller may also be disposed between the strap 304 and base member 302 on a roller surface similar to surface 330-*a*, provided that an upward-directed force keeps the roller in contact with the underside of the strap 304. Additional components shown in FIG. 8 will be discussed below in connection with FIGS. 21-26**.

Various views of the rear clamp member 308 are shown with reference to FIGS. 9-14. Corresponding views of the front clamp member 306 are shown with reference to FIGS. 15-20. Referring to FIGS. 9-14 in particular, the rear clamp member 308 is shown. The clamp member 308 may comprise a clamp body 900 from which two rail connection members 902, 904 extend. The clamp body 900 has an outer surface 906, an inner surface 908, two outer side surfaces 910, 912, and two inner side surfaces 914, 916. The rail connection members 902, 904 may include orifices 918, 920 with a counter bore for receiving a pin 332, which, may include a bolt and nut.

In one embodiment, the orifices 318, 320 may extend between the outer surface 906 and the inner surface 908. It will be understood that other embodiments may alternatively have only one orifice or more than two orifices if desired. The orifices 318, 320 may have a counter bore at the outer surface 906 to receive a head of the clamp fastener 334. At the inner surface 908, the orifices 318, 320 may emerge at a raised surface 922. The raised surface 922 may be raised relative to other portions of the inner surface 908 such that when the clamp member 308 is closed against a clamp extension (e.g., clamp extension member 312), the raised surface 922 contacts the clamp extension member 312 while the remainder of the inner surface 908 does not (see, e.g., FIG. 25). The raised surface 922 may advantageously provide a straighter connection of fastener through the orifices 318, 320 into the clamp extension member 310, 312 of the base member 302 (FIG. 3), particularly when the clamp extension member 310, 312 has multiple angular surfaces (e.g., surfaces 1008, 1010 of FIG. 27). The raised surface 922 may also relieve tolerances for other faces of the inner surface 908 of the clamp member 308, since only the raised surface 922 requires tolerances for close engagement with the clamp extension members. This may reduce the cost and complexity involved in manufacturing the inner surface 908. When the clamp fasteners 334 are inserted into the orifices 318, 320, they may secure the clamp body 900 to a clamp extension member 312 on a base member 302, thereby preventing an unintended opening of the clamp member 308. This may also obstruct access to the strap end 328 while the clamp member 308 is closed.

Figure 23:
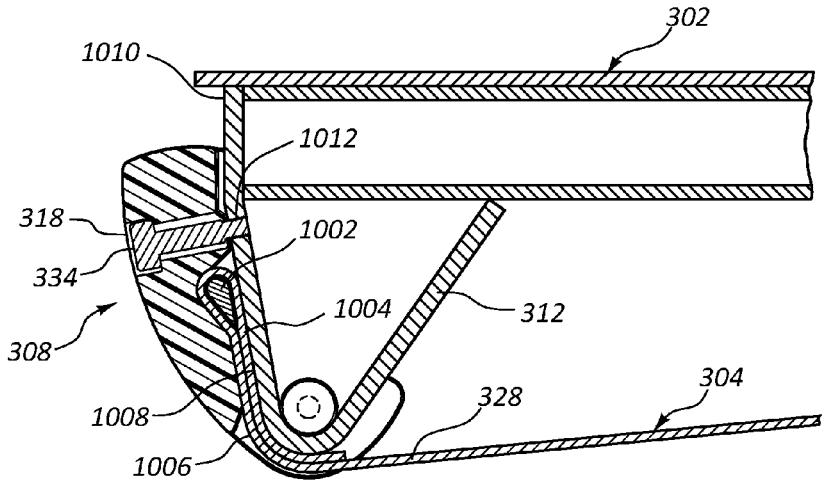
FIG. 23 is a partial side section view of an example of a clamp assembly with a rear clamp member closed with a section taken through an orifice in accordance with the present disclosure.

The inner surface 908 may further comprise a recessed portion 924 and a strap retention surface 926. The recessed portion 924 may be recessed into the clamp body 900. For example, the recessed portion 924 may be recessed into the clamp body 900 more deeply than the raised surface 922 and the strap retention surface 926 (as also seen in FIGS. 23-26). The recessed portion 924 may be advantageously shaped to receive a portion of a strap end (e.g., strap end 328) while the strap end is folded over itself between the clamp member 308 and clamp extension member (e.g., clamp extension member 312) and while the clamp member 308 has its raised surface 922 in contact with the clamp extension member (see also FIG. 25). In some embodiments, the recessed portion 924 is sized to accommodate a strap end 328 folded over a spacer 1002 while the clamp member 308 is closed, such as is shown in FIG. 23.

The recessed portion 924 may be advantageously shaped having an upper surface 928 and a lower surface 930. The upper and lower surfaces 928, 930 may comprise a curvature for a smooth transition there between. In some configurations, the upper surface 928 may have a greater slope than the lower surface 930 relative to the inner surface 908. This may provide the benefit of a more compact clamp design since less volume may be required for a folded strap end to be retained in the recessed portion 924 when compared to a configuration where the upper and lower surfaces 928, 930 have equal slopes or the lower surface 930 has a greater slope. Furthermore, this slope relationship may support a more gradual strap fold than would otherwise be required, so less stress may be placed on the strap end and clamp body 900 when under load.

The strap retention surface 926 may comprise ribs, scoring, or another textured surface. The texture of the retention surface 926 may therefore provide additional grip in securing a strap end within the clamp member 308. Such additional grip may help prevent the strap end from sliding out of the clamp member 308 or sliding around while the clamp member 308 is closed. In some embodiments, the strap retention surface 926 may comprise a clamp-fastener orifice 932. The clamp-fastener orifice 932 may be a recess in the inner surface 908 of the clamp body 900. As discussed in more detail in connection with FIGS. 21-26, the clamp-fastener orifice 932 may receive a head of a pin, fastener, or bolt (e.g., securing fastener 1000) passing through the strap 304 and into the clamp extension member 312 to provide yet another level of safety and security in preventing slippage or other unintended removal of the strap end from the clamp member 308 by holding folded-over portions of the strap end in place under the clamp member 308.

The inner side surfaces 914, 916 extend between the inner surface 908 and outer side surfaces 910, 912. With the clamp member 308 closed, the inner side surfaces 914, 916 secure each side of the strap end and spacer 1002 (if present) (see, e.g., FIG. 22) within the clamp member 308. Covering the sides of the strap end and the clamp extension member with the side surfaces 910, 912, 914, 916 may improve safety. The side surfaces 910, 912, may decrease accessibility to the strap end and the clamp extension member where they are held by the clamp member 308. The rail connection members 902, 904 may extend from the clamp body 900 (i.e., without the strap retention surface 926 extending between them) to provide ease in opening the clamp member 308 while the strap is taught, since the strap may occupy the area between the rail connection members 902, 904 as the clamp member 308 is pivoted open. (See, e.g., FIG. 22.) Additionally, the inner side surfaces 914, 916 may prevent the clamp member 308 from rotating or sliding laterally in relation to a clamp extension member 312 by straddling the sides of the clamp extension member 312 while the clamp member 308 is closed. (See, e.g., FIG. 21.)

Figure 16:
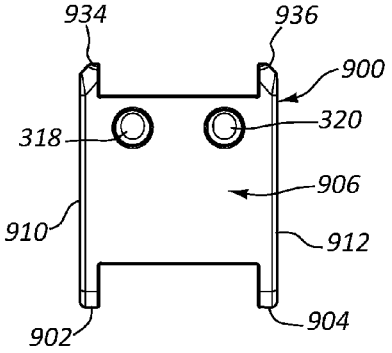
FIG. 16 is a front view of an example of a front clamp member in accordance with the present disclosure.
Figure 17:
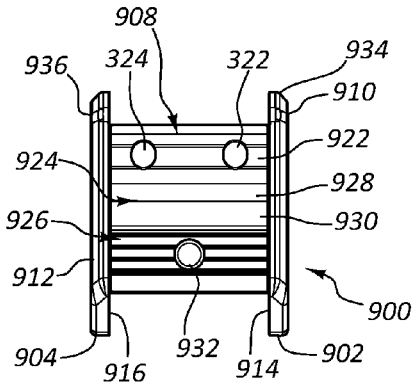
FIG. 17 is a rear view of an example of a front clamp member in accordance with the present disclosure.
Figure 18:
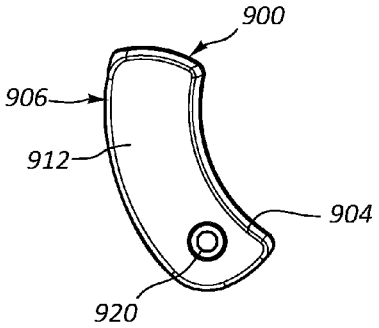
FIG. 18 is a left side view of an example of a front clamp member in accordance with the present disclosure.
Figure 19:
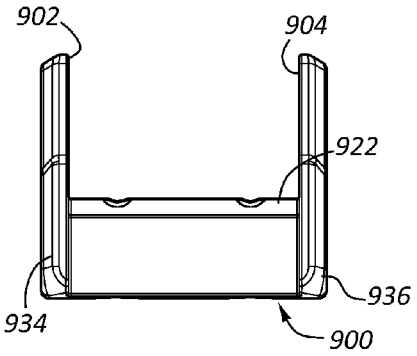
FIG. 19 is a top view of an example of a front clamp member in accordance with the present disclosure.
Figure 20:
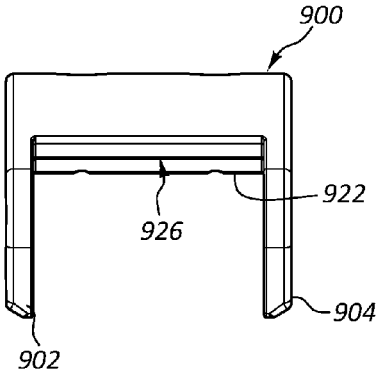
FIG. 20 is a bottom view of an example of a front clamp member in accordance with the present disclosure.

FIGS. 15-20 show surfaces and features of a front clamp member 306 that are similar to those discussed in relation to the rear clamp member 308, as indicated by like numerals. The front clamp member 306 further comprises base-side extension members 934, 936. The base-side extension members 934, 936 may advantageously provide additional support in keeping the clamp member 306 from moving laterally in relation to the base member 302 while closed and may allow the clamp member 306 to be completely closed against the clamp extension member 310 without interfering with the base member 302 directly above the clamp member 306 attachment point. Additionally, the front clamp member 306 has orifices 322, 324. FIG. 16 is a front view, FIG. 17 is a rear view, FIG. 18 is a left side view, FIG. 19 is a top view, and FIG. 20 is a bottom view of the front clamp member 306. By providing both the front clamp member 306 and the rear clamp member 308 to secure the strap 304, the strap 304 may be completely removable. This may be beneficial in cases where the rear end of the strap 328 is subject to increased wear in comparison to the front end 326 of the strap 304, since the entire strap 304 may be removed from the clamp members 306, 308, turned around, and reattached to the base member 302, more directly subjecting the front end 326 of the strap 304 to the roller.

FIGS. 21-26 illustrate the interaction between an embodiment of a clamp member 308, a strap end 328 of the strap 304, and a clamp extension member 312 of the base member 302. Corresponding elements in these figures may be referenced simultaneously in the following description of these figures.

The interaction between the front clamp member 306 and the clamp extension member 310 may be similar to the views shown in FIGS. 21-26 and would be shown essentially in a mirrored version of these figures. Thus, it will be appreciated by those having skill in the art that when referring to the clamp member 308, the clamp extension member 312, and associated parts, that clamp member 306, clamp extension member 310, and their associated parts may be interchangeable, unless otherwise noted.

Figure 21:
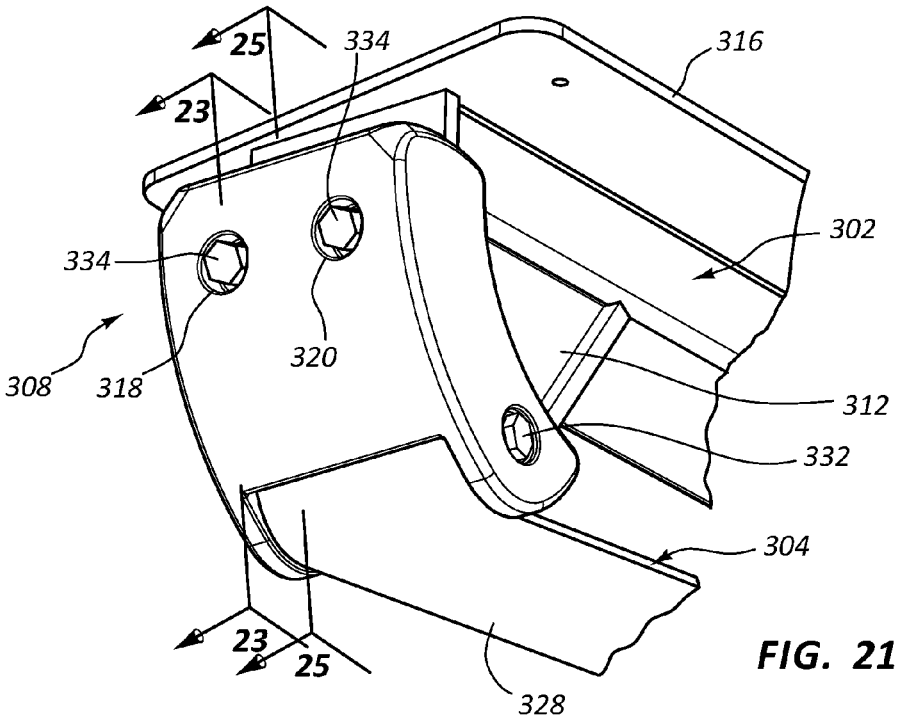
FIG. 21 is a partial perspective view of an example of a clamp assembly with the rear clamp member closed in accordance with the present disclosure.

FIG. 21 shows a partial perspective view of a rear clamp member 308 securing a strap end 328 to a clamp extension member 312. In FIG. 21, the strap end 328 is securely held in place by the clamp member 308. The clamp member 308 has two clamp fasteners 334 in threaded connection with the clamp extension member 312, preventing the clamp member 308 from inadvertently opening, even while under stress from the pressure of a roller on the strap 304.

Figure 22:
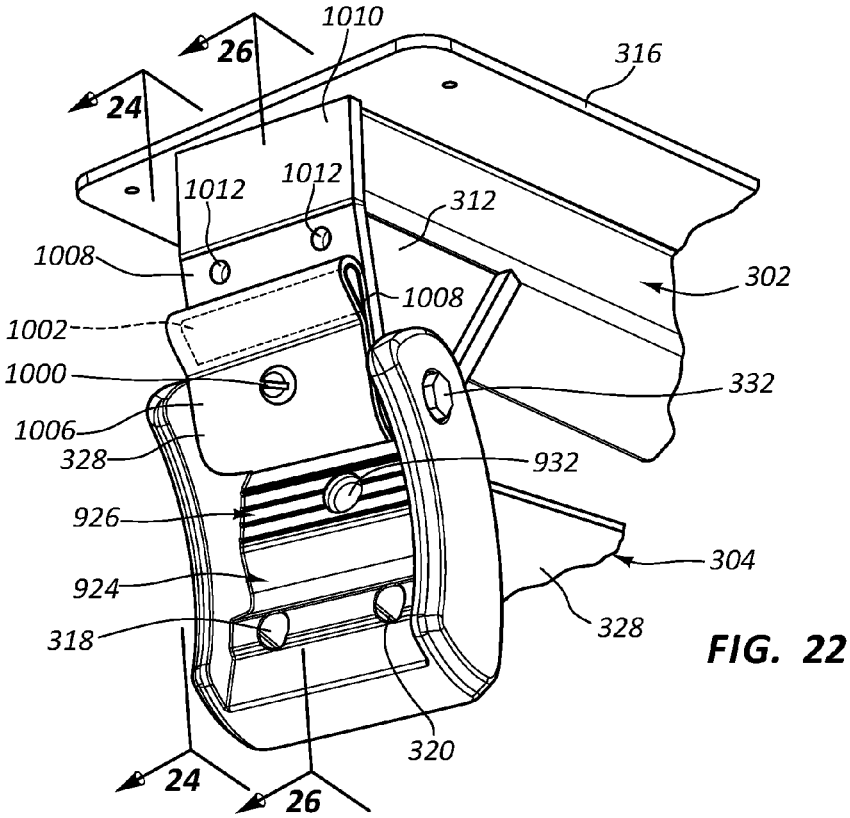
FIG. 22 is a partial perspective view of an example of a clamp assembly with the rear clamp member open in accordance with the present disclosure.

FIG. 22 shows the rear clamp member 308 opened, with the strap end 328 in place, and a securing fastener 1000 holding the strap end 328 to the clamp extension member 312 through one or more strap-fastening orifices 1015 (see FIG. 8) in the strap end 328. For example, the securing fastener 1000 may couple the strap 304 to the base member 302. When the clamp fastener 334 is removed and the clamp member 308 is opened, the strap end 328 may remain in place against the clamp extension member 312 due to the securing fastener 1000. The securing fastener 1000 may have a threaded portion for connection to the clamp extension member 312 at a base-fastener orifice (see, e.g., base-fastener orifice 1014 of FIG. 27). The securing fastener 1000 may also have a head portion preventing the strap end 328 from slipping off the securing fastener 1000 while it is securing the strap 304 to the clamp extension member 312. The clamp-fastener orifice 932 may accept at least a portion of the securing fastener 1000. For example, the clamp-fastener orifice 932 may be a recess and may accept the head of the securing fastener 1000.

In some embodiments, the securing fastener 1000 may be welded to or attached to the clamp extension member 312, thereby providing additional strength to the connection between the securing fastener 1000 and the base member 302. In these embodiments, the securing fastener 1000 may not have a head to facilitate easier removal of the strap end 328 from the clamp extension member 312. Alternatively, the one or more strap-fastening orifices 1015 may be shaped to slip around a head on the securing fastener 1000.

In yet other embodiments, the securing fastener 1000 may be welded or otherwise attached to the strap retention surface 926 of the clamp body 900 (see FIG. 10) and extend into the clamp extension member 312 (e.g., through base-fastener orifice 1014) when the clamp member 308 is closed. The securing fastener 1000 may not be threaded in order to facilitate easier insertion and removal of the securing fastener 1000 from the clamp extension member 312 as the clamp member 308 is pivoted. In these embodiments, the strap end 328 may not be coupled to the clamp extension member 312 by the securing fastener 1000 when the clamp member 308 is opened, but instead may be engaged with the inner surface 908 of the clamp member 308 upon opening.

In yet other embodiments, the securing fastener 1000 may secure the strap end 328 by passing through the clamp member 308 at the outer surface 906 and strap retention surface 926. For example, an orifice (not shown) in the clamp body 900 may accept at least a portion of the securing fastener 1000. The securing fastener may also pass through the strap end 328 and clamp extension member 312. In this embodiment, the securing fastener 1000 may act in addition to or in place of one or more clamp-fasteners 334.

Furthermore, the securing fastener 1000 may be secured to a threaded recess or orifice in the strap retention surface 926 of the clamp body 900, thereby securing the strap end 328 to the clamp member 308. In such a configuration, removing the strap end 328 from the clamp member 308 may require removal of the securing fastener 1000 from the clamp member 308. Other orientations and configurations for the securing fastener 1000 will be recognized by those skilled in the art. For example, in some configurations the number of securing fasteners may be increased to a number greater than one and they may be oriented to pierce the strap end 328 in a plurality of different locations. Additionally, a securing fastener 1000 may be accessible from an external surface of the clamp extension member 312 and passing into the clamp member 308 through the strap end 328.

The strap-fastening orifices 1015 in the strap end 328 may be sized and positioned to receive the securing fastener 1000 when the strap end 328 is folded over itself and properly positioned in the clamp member 308. The strap-fastening orifices 1015 may allow the strap 304 to be repositioned, i.e., lengthened or shortened, loosened or tightened, as needed. For example, a plurality of orifices along the length of the strap end 328 may allow the strap 304 to be removed from the clamp member 308, reoriented and/or re-folded with different orifices receiving the securing fastener 1000, and then secured again by the clamp member 308 with a different amount of slack in the strap 304. In such embodiments, the strap 304 may selectively provide different ranges of curvature to a roller and give different ranges of smoothness to the motion of the user on the elliptical exercise machine. Orifices in the embodiment shown in FIGS. 21-26 may be positioned centrally in the width of the strap 304 and align when a sufficient amount of a first portion 1004 of the strap end 328 overlaps with a second portion 1006 of the strap end 328 when folded over itself.

In some embodiments, the securing fastener 1000 may be omitted, along with related elements such as the clamp-fastener orifice 932 in the clamp member 308 and the strap-fastening orifices 1015 in the strap end 328. Thus, the strap 304 may be held in place by pressure from the clamp member 308, or may be held with assistance from the spacer 1002.

Figure 24:
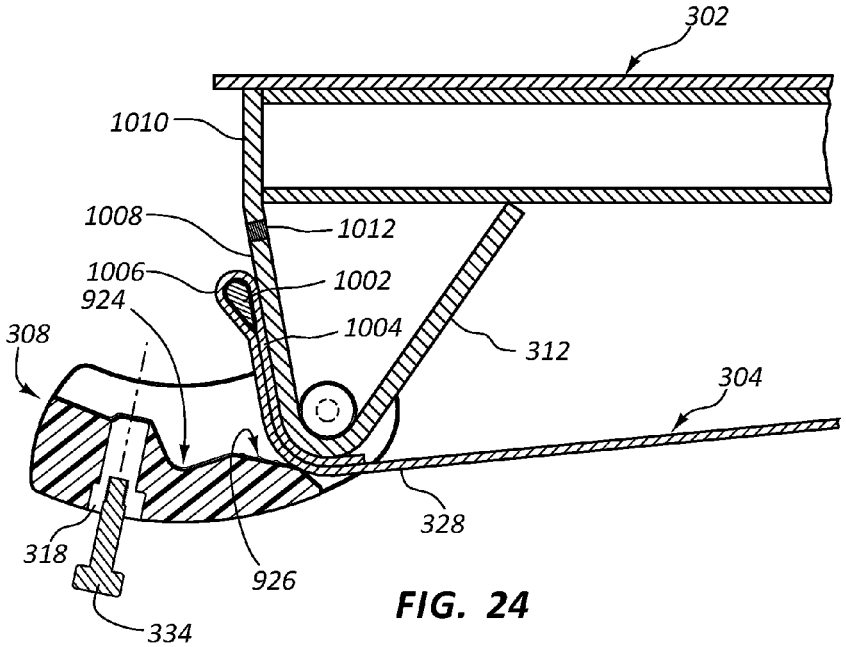
FIG. 24 is a partial side section view of an example of a clamp assembly with a rear clamp member open with a section taken through an orifice in accordance with the present disclosure.
Figure 26:
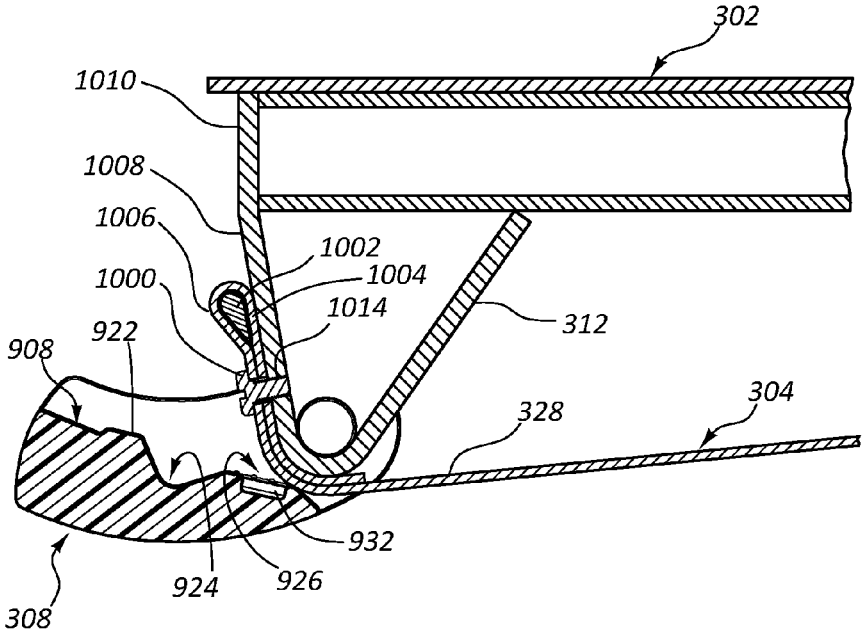
FIG. 26 is a partial side section view of an example of a clamp assembly with a rear clamp open with a section taken through a base-fastener orifice in accordance with the present disclosure.

The spacer 1002 may be part of the clamp assembly 300. The spacer 1002 may be positioned in the folded portion of the strap end 328, spacing apart the first portion 1004 of the strap end 328 from the second portion 1006 of the strap end 328, as shown in FIGS. 24 and 26. The first portion 1004 is a terminal end of the strap 304 that lies between the second portion 1006 of the strap end 328 and the clamp extension member 312, and the second portion 1006 is the strap portion lying between the first portion 1004 and the clamp member 308.

The spacer 1002 may be formed of any rigid, durable material, including metals and plastics. In some embodiments, the spacer 1002 may include a nylon outer layer, which may provide rigidity and nonstick properties. The spacer 1002 may serve to keep a section of the first and second portions 1004, 1006 spaced apart, thereby preventing the strap end 328 from potentially sliding out of the bottom of the clamp member 308 when the strap 304 is under pressure, particularly in embodiments where there is no securing fastener 1000 to restrain sliding movement of the strap 304 in the clamp member 308.

The spacer 1002 may also act as a fail-safe for securing the strap 304 in the clamp member 308 even when a securing fastener 1000 is present. The spacer 1002 may be designed so that with the portions 1004, 1006 of the strap 304 on each side of the spacer 1002, the combined elements fit snugly between a recessed portion of the clamp member body (e.g., recessed portion 924) and a face of the clamp extension member 312 (e.g., attachment surface 1008). A tight fit between the recessed portion 924 and the attachment surface 1008 provides an interference fit for the strap end 328, making inadvertent loosening or removal of the strap 328 difficult. This may be especially true when pressure from the strap 304 pulls down on the spacer 1002, whether the strap is pulled principally vertically or principally laterally by the roller.

The spacer 1002 is shown having a teardrop-prism shape in FIGS. 22-26, but other shapes may be implemented, including, for example, a cylinder or other polygonal prism. A teardrop shape with rounded edges may provide the particular benefit of keeping the strap end 328 more tightly held by clamp member 308 since it has the first and second surface 928, 930 of the recessed portion 924 which correspond with a teardrop shape. Furthermore, a spacer 1002 with edges rounded (as shown) may reduce wear on the strap 304 and reduce stress concentrations that could be introduced by sharp corners, leading to longer strap life, particularly if the strap is readjustable, and a more even stress distribution on the inner surface 908 of the clamp member 308.

The spacer 1002 may also beneficially have an overall width that fits between the inner side surfaces 914, 916 of the clamp body 900, thereby providing another layer of security in preventing the spacer 1002 from being dislodged laterally while covered by the clamp member 308. In some embodiments, the ends of the spacer 1002 may be integrated with or welded/attached to the inner side surfaces 914, 916. In such an embodiment, the strap end 328 may be threaded around the spacer 1002 when the clamp member 308 is separated from the attachment surface 1008 of the clamp extension member 312. Additionally, if a securing fastener 1000 is applied to that embodiment, the securing fastener 1000 is preferably sized to be inserted through orifices of the strap from the terminal portion 1004 side of the folded strap end 328.

When the strap end 328 is folded over itself, the terminal portion 1004 may cover the lower portion of the attachment surface 1008 of the clamp extension member 312 such that the second portion 1006 of the strap end 328 does not contact the attachment surface 1008. This may reduce wear on the second portion 1006 where it may be subjected to increased stresses where the first/terminal portion 1004 ends and the second portion 1006 contact the attachment surface 1008.

Figure 25:
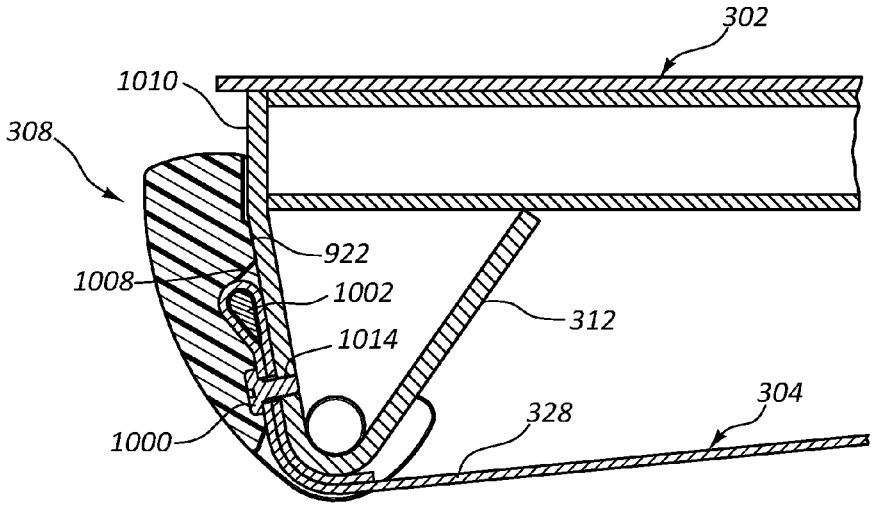
FIG. 25 is a partial side section view of an example of a clamp assembly with a rear clamp member closed with a section taken through a belt-holding bolt orifice in accordance with the present disclosure.

FIGS. 23-24 show cross-sectional views of the closed and open clamp member 308 connected to the clamp extension member 312. The cross-section is taken through one of the orifices 318, 320, as indicated by section markers 23 and 24 in FIGS. 21-22. FIGS. 25-26 show additional cross-sectional views of the closed and open clamp member 308 connected to the clamp extension member 312, where the section is taken through a midpoint of the clamp member 308 and clamp extension member 312, as indicated by section markers 25 and 26 in FIGS. 21-22.

As shown in FIG. 25, the base-fastener orifice 1014, the clamp-fastener orifice 932, and the strap-fastening orifice 1015 may be positioned to collectively receive the securing fastener 1000. The clamp-fastener orifice 932 may comprise a recess which may accept at least a portion of the securing fastener 1000. The securing fastener 1000 may couple the strap 304 to the base member 302. For example, the securing fastener 1000 may comprise a series of threads which may mate with a series of threads within the base-fastener orifice 1014. The strap 304 may be clasped between the base member 302 and the clamp member 308. The portion of the clamp member 308 contacting the strap 304 may be textured (e.g. retention surface 926, see at least FIG. 9). In some embodiments, as shown, the strap 304 may be folded over itself at an end 328 of the strap 304. The clamp member 308 may additionally comprise a recess for retaining at least a portion of the folded over strap 304 (e.g. recessed portion 924, see at least FIG. 9). The strap 304 may extend from a first end of the base member 302 to a second end of the base member 302.

The strap 304 may be inserted through the clamp member 304 and tighten to a desired length such as shown in FIGS. 23-34 or tighten until the openings in the strap 304 are aligned with the base fastener orifice 1014. In examples where the orifices align, a securing fastener 1000 is inserted through the orifices. The clamp member 308 is then closed to secure the strap's end in place. As a result, a consistent tension is applied to the strap 304 through the clamp member 308.

Figure 27:
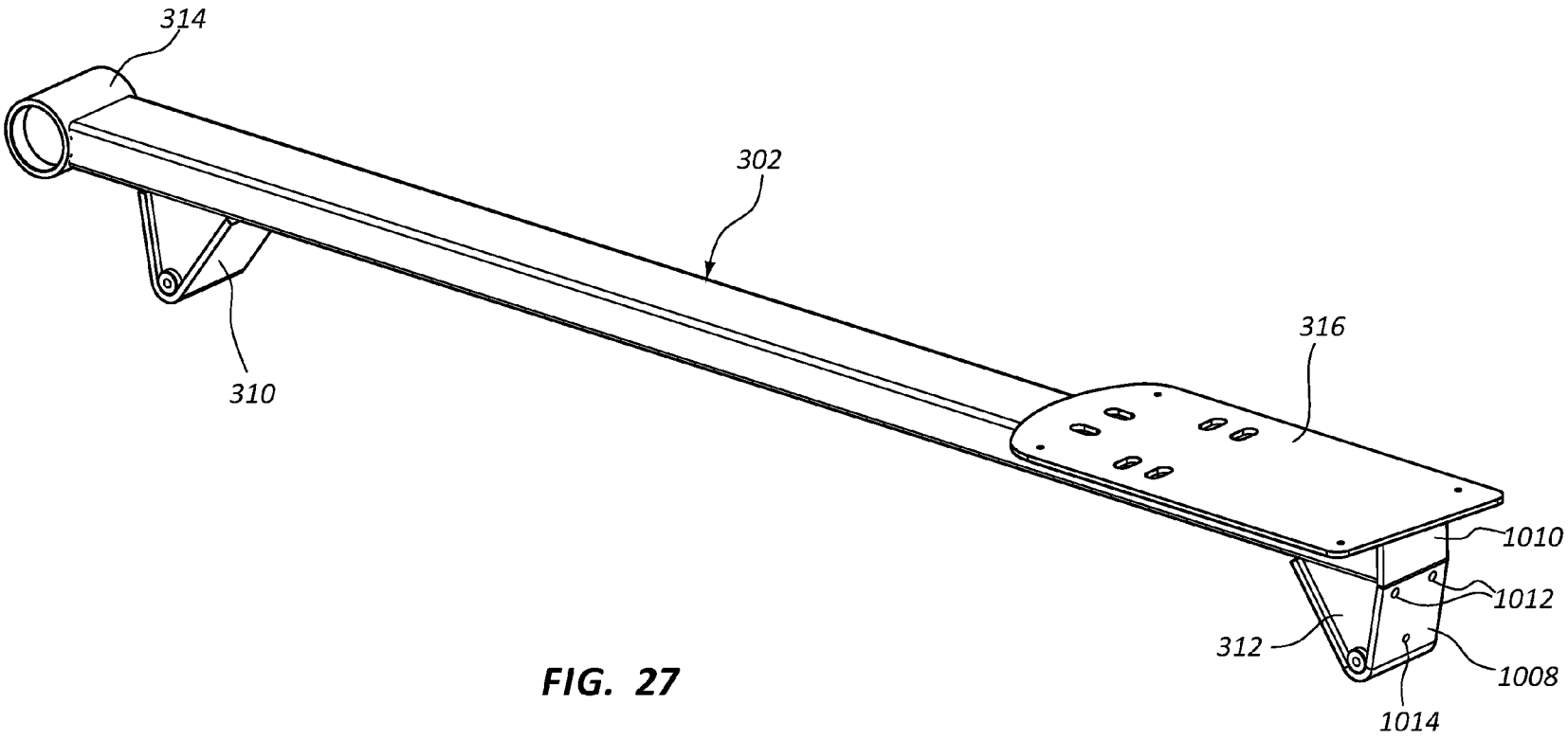
FIG. 27 is a perspective view of an example of a base member of a clamp assembly in accordance with the present disclosure.

FIG. 27 is a perspective view of the base member 302 without clamp members 306, 308 or strap 304. For the front clamp extension member 310, there is no end surface 1010 above the attachment surface 1008 due to the base member 302 extending to the pivot joint member 314.

FIG. 27 provides a depiction of the attachment surface 1008 and the end surface 1010 of the base member 302. The attachment surface 1008 may include a plurality of orifices 1012 corresponding in size and position to orifices 318, 320 in clamp member 308. The orifices 1012 may be threaded to provide a system for securing the clamp fasteners 334 to the base member 302. In some embodiments, the orifices 1012 may be accessible from the side of the attachment surface 1008 opposite the clamp member 308. In another embodiment, the clamp extension member 312 may be a solid member where the orifices 1012 may be located on side panels or positioned proximate the sides of the clamp extension member 312.

Another portion of the attachment surface 1008 may have a base-fastener orifice 1014. The base-fastener orifice 1014 may receive the securing fastener 1000 through strap-fastening orifices 1015, thereby coupling the strap end 328 to the base member 302.

In some embodiments (not pictured), the orifices 318, 320 may direct the clamp fastener 334 through portions of the strap end 328. Thus, the orifice 318, 320 may align with a base-fastener orifice 1014 and a clamp fastener 334 may pass through strap-fastening orifices 1015 in the folded strap end 328 to secure the strap 304 to the clamp member 308 and clamp extension member 312. In doing so, at least one orifice 318, 320 may be positioned peripherally downward from the recessed portion 924 on the clamp body 900. The recessed portion 924 may also be repositioned upward in the clamp body 900 to allow the clamp fastener 334 to provide additional leverage in keeping the clamp member 308 closed (since their leverage is defined by their distance from the axis of rotation of the clamp member 308, i.e., the pin 332).

In other embodiments (not pictured), the strap end 328 may alternatively not be folded over itself while clamped into place by the clamp member 308. The strap retention surface 926 may hold the strap end 328 in place due to its texture. To do so, the strap retention surface 926 may extend closer to the attachment surface 1008 since, as pictured in the figures, it retains a double thickness of the strap end 328. Furthermore, a securing fastener 1000 passing through an orifice in the unfolded strap end may secure the strap 304. In some of these embodiments, the clamp fastener 334 may pass through the unfolded strap end and allow a terminal portion of the unfolded strap end to extend upward from the top of the clamp member 308.

In some configurations, the aspects described in relation to the rear clamp member 308 and rear clamp extension member 312 may be applied to the front clamp member 306 and front clamp extension member 310. In other configurations, only one clamp member 306, 308 is used to removably or adjustably hold the strap 304 to the base member 302.

As generally shown in the figures, the heights of the clamp extension members 310, 312 relative to the base member 302 are at least approximately equal. In other embodiments, however, the clamp extension members 310, 312 may extend to different distances. For example, the rear clamp extension member 312 may extend further from the base member 302 than the front clamp extension member 310. In an uneven arrangement, the extensions may produce different angles of orientation for the foothold attachment plate 316, and may produce different rates of change of radius of curvature as the roller moves toward one clamp extension member as opposed to the other. For example, if the rear clamp extension member 312 is taller than the front clamp extension, the strap 304 may provide a different transition in curvature radius when the roller approaches the rear end when compared to the transition in curvature radius when the roller approaches the front end.

Figure 28:
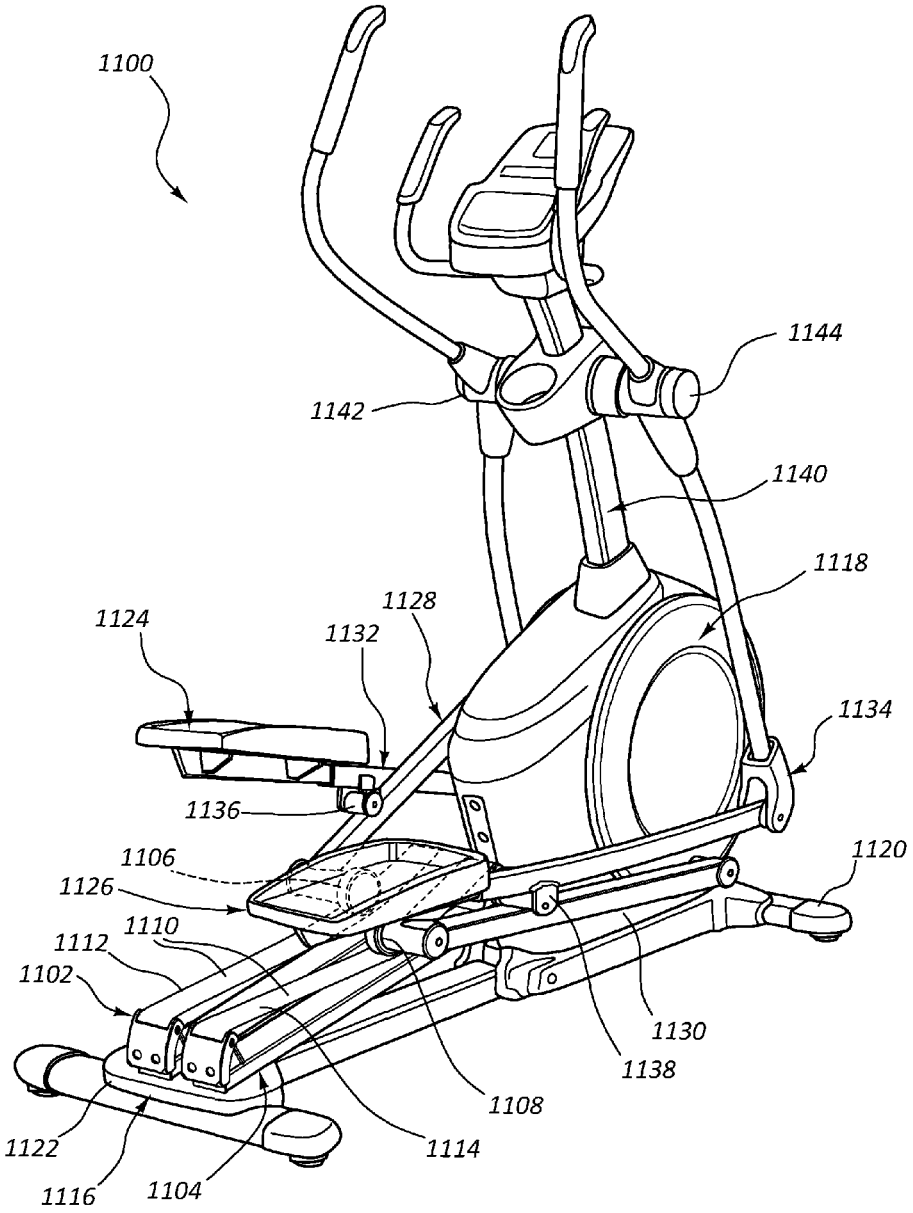
FIG. 28 is a perspective view of an example of an alternate embodiment of an elliptical exercise machine having clamp assemblies in accordance with the present disclosure.

FIG. 28 is a perspective view of an elliptical exercise machine 1100 having clamp assemblies 1102, 1104. In this embodiment, rollers 1106, 1108 are positioned to roll on upward-facing surfaces 1110 of the straps 1112, 1114 of the clamp assemblies 1102, 1104. The elliptical exercise machine 1100 may include a base support structure 1116 including a drive unit 1118 at a front end 1120. The rear end 1122 of the machine 1100 may bear the clamp assemblies 1102, 1104. Reciprocating foot supports 1124, 1126 may be driven by the drive unit 1118 via main roller linkages 1128, 1130 and jointed support linkages 1132, 1134. The rollers 1106, 1108 may be positioned at the rear end of the main roller linkages 1128, 1130, and may move across the upward-facing surfaces 1110 of the straps 1112, 1114 as the main roller linkages 1128, 1130 are driven to reciprocate by rotation at the drive unit 1118. Secondary rollers 1136, 1138 may move across the surface of the main roller linkages 1128, 1130, and may drive the reciprocating foot supports 1124, 1126 to reciprocate via the jointed support linkages 1132, 1134 which may pivotally connect to the upright column 1140 at pivot points 1142, 1144.

The elliptical exercise machine 1100 may illustrate one way a clamp and clamp assembly may be implemented in positions where rollers are proximate the top of strap surfaces 1110. Here, the incline of the clamp assemblies 1102, 1104 may be adjustable, thereby providing a varying level of resistance to a user on the machine 1100. The clamp assemblies 1102, 1104 may be shorter than the clamp assemblies of the elliptical exercise machine 100 of FIG. 1. Therefore, their rate of change of curvature or slope may be greater, and therefore more noticeable, to the user. The clamp assemblies 1102, 1104 may also be more accessible in this configuration, allowing easier manipulation of clamps and straps for maintenance and adjustments, when needed. This may be convenient when the elliptical exercise machine 1100 has multiple users with varying weights, since the straps 1112, 1114 may need to be adjusted when users change to ensure a smooth riding experience.

INDUSTRIAL APPLICABILITY

In general, the invention disclosed herein may provide an elliptical exercise machine that reduces the likelihood of the roller hitting a hard stop as it travels on a flexible surface. The flexibility of the strap as it contacts a moving roller creates resistance to relative movement between the roller and the rail assembly as the roller approaches opposing ends of the base member. The clamps securing the strap to the rail assembly may comprise a number of orifices for coupling the clamps to the base member. Additionally, the clamps may comprise a looped-strap recess and peripherally-located strap retention surface to secure the strap with multiple types of retaining features, ensuring that the strap is not unintentionally removable and reducing wear on the strap and other components.

A clamp assembly having a flexible strap that provides these benefits may be predictably fixed relative to the frame of the elliptical exercise machine, and the roller may be movable with the foot support. In alternative arrangements, the roller may be fixed relative to the frame and the clamp rail assembly may be movable via the foot support. These arrangements may correspond to front and rear drive elliptical machines, respectively. The present systems and methods may provide for reduced relative movement between the roller and the clamp assembly as the roller approaches an end of the clamp assembly where the strap meets the base member. This reduced relative movement may lessen the impact that otherwise occurs as the roller reaches the end of a rigid, planar track surface. In some arrangements, the reduced relative movement may result in complete stoppage of the roller relative to the clamp assembly before the roller reaches the end of the strap, thereby eliminating impact forces that may otherwise occur. The resulting performance of the elliptical exercise machine when using straps securely fixed to a clamp assembly may include a smoother operation that avoids jarring forces during reciprocal elliptical movement of the foot supports during use. Additionally, the present systems and methods provide for predictable and repeatable coupling of the strap to the base member, ensuring the proper strap tension for operation.

The present system and method provides for an elliptical exercise machine with rail assemblies having at roller suspension surface. More specifically, the rail assemblies include straps attached to clamp extensions at the ends of rail bodies by strap clamps. The strap clamps may employ multiple methods of securing the ends of the straps, thereby avoiding slippage and providing strap surfaces for rollers that slow relative movement between the rail assemblies and rollers that move along the rail assemblies during operation of the elliptical machine. The rail assemblies are configured to limit or eliminate impact forces typically experienced when the roller reaches the end of a track surface on a guide rail, thereby providing improved comfort for the operator and reduced machine wear when using the elliptical exercise machine.

What I claim is:

1. A clamp assembly for a track of an elliptical exercise machine, comprising:

a base member coupled to a guide rail of the elliptical exercise machine, the base member having at least one base-fastener orifice;

a clamp member pivotally coupled to the base member, the clamp member having at least one clamp-fastener orifice;

a strap proximate the base member and the clamp member, the strap having at least one strap-fastener orifice;

wherein the at least one base-fastener orifice, the at least one clamp-fastener orifice, and the at least one strap-fastener orifice are positioned to collectively receive a securing fastener.

2. The clamp assembly of claim 1, wherein the strap is coupled to the base member with the securing fastener.

3. The clamp assembly of claim 1, wherein the at least one clamp-fastener orifice comprises a recess positioned to accept at least a portion of the securing fastener.

4. The clamp assembly of claim 1, wherein the strap is clasped between the base member and the clamp member.

5. The clamp assembly of claim 4, wherein a portion of the clamp member contacting the strap is textured.

6. The clamp assembly of claim 1, the clamp member further comprising:

a plurality of rail connection extensions extending from a body of the clamp member, the plurality of rail connection extensions pivotally connecting the clamp member to the base member.

7. The clamp assembly of claim 1, wherein the strap comprises a fold at a first end of the strap.

8. The clamp assembly of claim 7, wherein the clamp member comprises a recess retaining at least a portion of the fold of the strap.

9. The clamp assembly of claim 1, wherein the strap extends from a first end of the base member to a second end of the base member opposite the first end.

10. A guide rail assembly for an elliptical exercise machine, the guide rail assembly comprising:

a guide rail pivotally coupled to a support structure for the elliptical exercise machine;

a base member comprising a first base end and a second base end opposite the first base end, the first base end pivotally coupled to the guide rail and at least one base-fastener orifice proximate one end of the base member;

at least one clamp member pivotally coupled to the base member, the at least one clamp member having at least one clamp-fastener orifice;

a strap proximate the base member and the at least one clamp member, the strap having at least one strap-fastener orifice;

wherein the at least one base-fastener orifice, the at least one clamp-fastener orifice, and the at least one strap-fastener orifice are positioned to collectively receive a securing fastener.

11. The guide rail assembly of claim 10, wherein the strap extends away from a longitudinal portion of the base member and the strap is coupled to the base member with the securing fastener.

12. The guide rail assembly of claim 10, wherein a first strap end of the strap comprises a fold and the first strap end is secured by the at least one clamp member.

13. The guide rail assembly of claim 12, wherein a body of the at least one clamp member comprises a recess, the recess receiving the fold of the strap.

14. The guide rail assembly of claim 13, wherein the recess is centrally-located on the body of the at least one clamp member.

15. The guide rail assembly of claim 14, wherein a spacer is positioned within the fold of the strap between the recess of the body of the at least one clamp member.

16. An elliptical exercise machine, comprising:

a support structure proximate a support surface;

a first foot support and a second foot support, each of the first and second foot supports movably linked to the support structure;

a first guide rail assembly and a second guide rail assembly positioned to guide reciprocal movement of the first and second foot supports, at least one of the first and second guide rail assemblies includes:

a base member coupled to a guide rail, the base member having at least one base-fastener orifice;

a clamp member pivotally coupled to the base member, the clamp member having at least one clamp-fastener orifice;

a strap proximate the base member and the clamp member, the strap having at least one strap-fastener orifice; and wherein the at least one base-fastener orifice, the at least one clamp-fastener orifice, and the at least one strap-fastener orifice are positioned to collectively receive a securing fastener.

17. The elliptical exercise machine of claim 16, wherein the first and second guide rail assemblies are fixed relative to the support structure.

18. The elliptical exercise machine of claim 17, further comprising a drive assembly proximate a front portion of the elliptical exercise machine, each of the first and second foot supports being linked to the drive assembly such that each of the first and second foot supports is movably linked to a base support structure.

19. The elliptical exercise machine of claim 16, further comprising a drive assembly proximate a rear portion of the elliptical exercise machine, each foot movable by the drive assembly such that each foot support reciprocates around an axis formed by the drive assembly.

20. The elliptical exercise machine of claim 16, further comprising an upright support structure extending upward from a front portion of the support structure.

* * * * *